US009752316B2

(12) United States Patent
Thornton

(10) Patent No.: US 9,752,316 B2
(45) Date of Patent: Sep. 5, 2017

(54) MULTI-STORY BUILDING FLOOR SUPPORT SYSTEM

(71) Applicant: Charles H. Thornton, Easton, MD (US)

(72) Inventor: Charles H. Thornton, Easton, MD (US)

( * ) Notice: Subject to any disclaimer, the term of this patent is extended or adjusted under 35 U.S.C. 154(b) by 61 days.

(21) Appl. No.: 14/865,001

(22) Filed: Sep. 25, 2015

(65) Prior Publication Data

US 2017/0089062 A1 Mar. 30, 2017

(51) Int. Cl.

| | |
|---|---|
| ***E04H 1/00*** | (2006.01) |
| ***E04B 1/41*** | (2006.01) |
| ***E04B 1/16*** | (2006.01) |
| ***E04B 1/24*** | (2006.01) |
| *E04B 1/35* | (2006.01) |
| *E02D 27/12* | (2006.01) |

(52) U.S. Cl.

CPC ..... *E04B 1/4114* (2013.01); *E04B 1/16* (2013.01); *E04B 1/24* (2013.01); *E02D 27/12* (2013.01); *E04B 1/3516* (2013.01); *E04B 2001/4192* (2013.01)

(58) Field of Classification Search

CPC ..... E02D 27/12; E04B 1/3516; E04B 1/4114; E04B 1/16; E04B 1/24; E04B 2001/4192

USPC ... 52/236.5, 79.14, 236, 741.14, 745.2, 280, 52/272, 264, 249, 263

See application file for complete search history.

(56) References Cited

U.S. PATENT DOCUMENTS

| | | | | |
|---|---|---|---|---|
| 3,721,056 | A * | 3/1973 | Toan | E04B 1/20 52/236.6 |
| 3,971,179 | A * | 7/1976 | Bodocsi | E04B 1/24 52/223.11 |
| 3,981,109 | A | 9/1976 | Termohlen | |
| 4,071,988 | A * | 2/1978 | Bowes | E04B 1/3511 52/127.1 |
| 4,667,923 | A * | 5/1987 | Lee | E04G 11/082 249/148 |
| 5,507,124 | A * | 4/1996 | Tadros | E04B 5/43 52/251 |
| 5,528,877 | A * | 6/1996 | Franklin | E04B 1/3516 264/33 |
| 6,925,761 | B1 * | 8/2005 | De La Marche | E04B 1/34815 52/220.1 |
| 7,640,702 | B2 | 1/2010 | Termohlen | |

(Continued)

*Primary Examiner* — Chi Q Nguyen

(74) *Attorney, Agent, or Firm* — Global IP Counselors, LLP

(57) ABSTRACT

A multi-story building floor support system is basically provided with a receptacle and a first support member. The receptacle is configured to be embedded into a building core. The receptacle includes a first chamber, a first support plate and a second support plate. The first chamber has with a first insertion opening. The first support plate protrudes from a top surface of the first chamber. The second support plate protrudes from a bottom surface of the first chamber. The first and second support plates are structured to retain the receptacle inside the building core. The first support member has a first end section and a second end section. The first end section is configured to be inserted into the first receiving opening of the first chamber such that the second end section projects outwardly from the first receiving opening of the first chamber.

14 Claims, 11 Drawing Sheets

(56) References Cited

U.S. PATENT DOCUMENTS

| | | | | |
|---|---|---|---|---|
| 7,784,231 | B2 | 8/2010 | Termohlen | |
| 2008/0276550 | A1* | 11/2008 | Termohlen | E02D 27/12 52/169.9 |
| 2009/0049762 | A1* | 2/2009 | Termohlen | E04G 11/22 52/79.11 |

* cited by examiner

MULTI-STORY BUILDING FLOOR SUPPORT SYSTEM

BACKGROUND

Field of the Invention

This invention generally relates to a multi-story building floor support system. More specifically, the present invention relates to a multi-story building floor support system having a receptacle that is embedded into the building core and a chamber of the receptacle that is configured to receive a floor support structure.

Background Information

A conventional multi-story building can be constructed by building a building core as well as successive floor structural members at the ground level that are then lifted to the desired elevations of the building core. These floor structural members are supported at the various desired elevations adjacent the building core by support structures that are inserted into receptacles in the building core. Such receptacles may be constructed to include at least one chamber that receives the support structures therein. Recently, building core receptacles that support the floor structural members are constructed to be lightweight in order to decrease the cost of construction while maintaining durability against shear and strain forces caused by the external loads of the floor structural members.

SUMMARY

Generally, the present disclosure is directed to various features of a multi-story building floor support system.

One aspect of the present invention is to provide a multi-story building floor support system having a receptacle and a first support member. The receptacle is configured to be embedded into a building core. The receptacle includes a first chamber, a first support plate and a second support plate. The first chamber has a first insertion opening. The first support plate protrudes from a top surface of the first chamber. The second support plate protrudes from a bottom surface of the first chamber. The first and second support plates are structured to retain the receptacle inside the building core. The first support member has a first end section and a second end section. The first end section is configured to be inserted into the first receiving opening of the first chamber such that the second end section projects outwardly from the first receiving opening of the first chamber.

A second aspect is to provide a multi-story building floor support system having a building core, a plurality of receptacles and a plurality of floor structural members. The building core is constructed from a slip-form process and has a plurality of corner areas at each elevation. Each of the receptacles is configured to be embedded into the building core. Each of the receptacles has a first chamber and a second chamber that are vertically aligned. The first chamber is configured to receive a first support member. The second chamber is configured to receive a second support member. Each of the floor structural members is supported at an elevation by the support members.

Also other objects, features, aspects and advantages of the disclosed a multi-story building floor support system will become apparent to those skilled in the art from the following detailed description, which, taken in conjunction with the annexed drawings, discloses three embodiments of a multi-story building floor support system.

BRIEF DESCRIPTION OF THE DRAWINGS

Referring now to the attached drawings which form a part of this original disclosure.

DETAILED DESCRIPTION OF EMBODIMENTS

Figure 1:
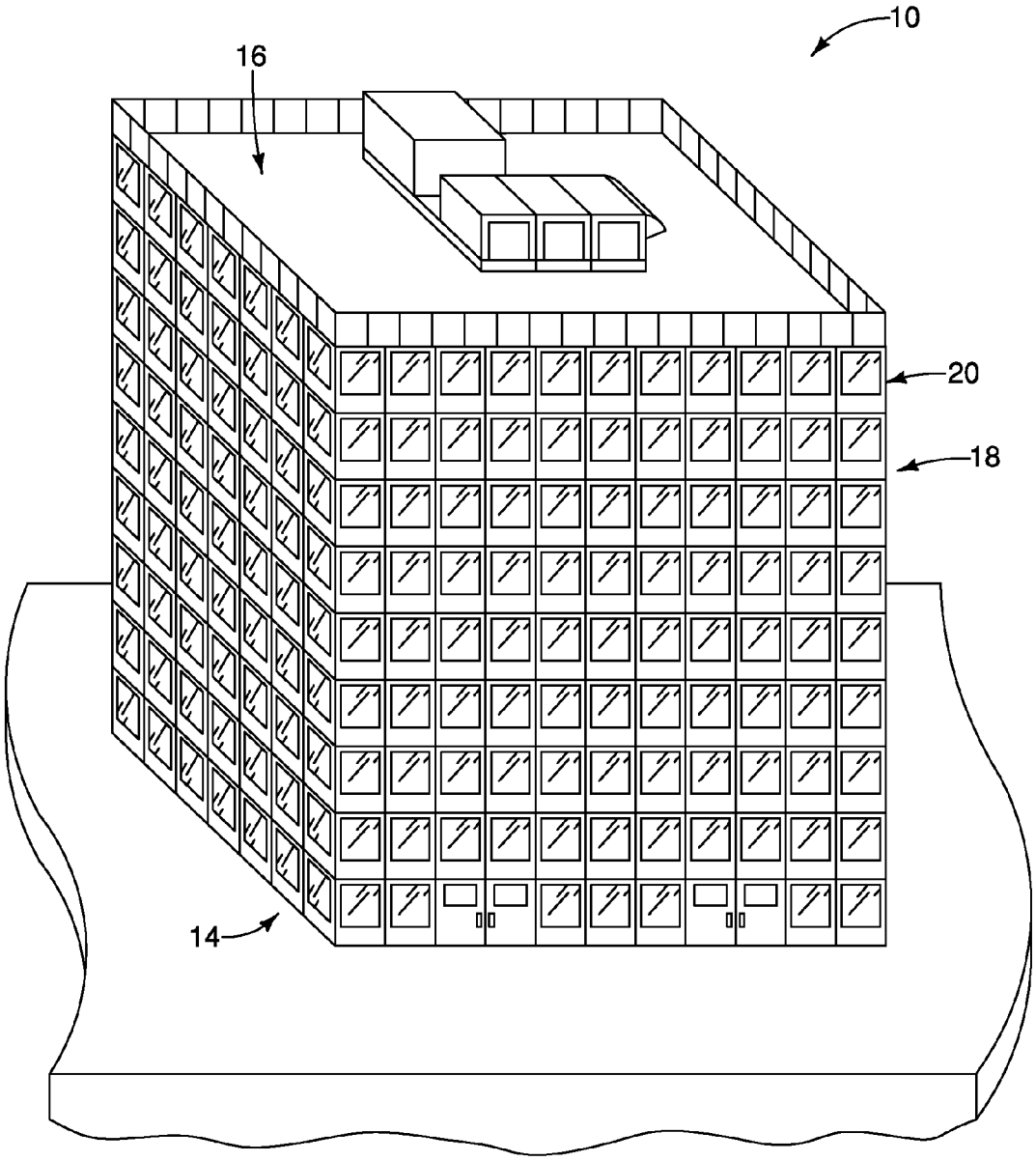
FIG. 1 is a top perspective view of a fully constructed multi-story building in accordance with one illustrated embodiment.
Figure 2:
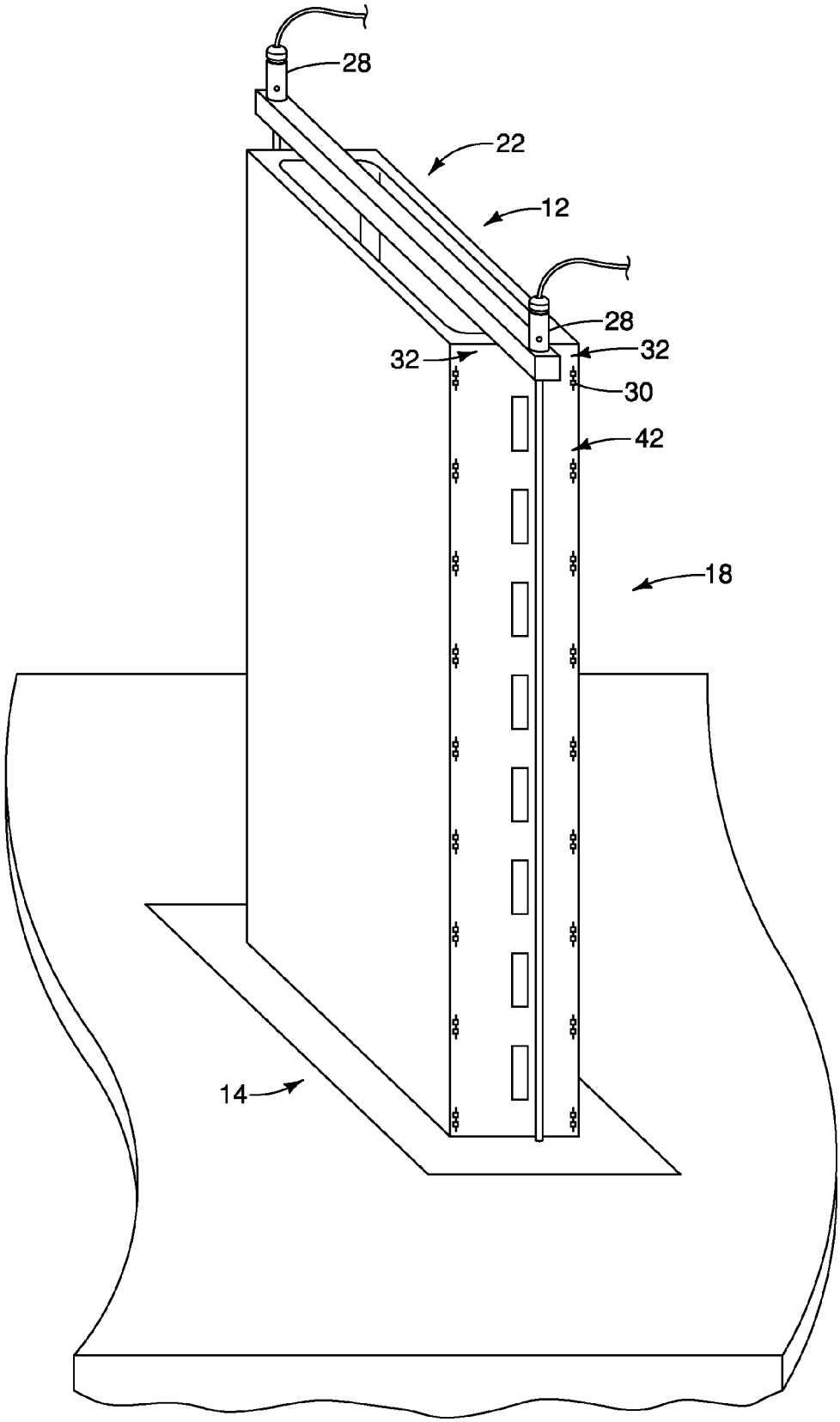
FIG. 2 is a top perspective view of a building core of the multi-story building of FIG. 1 having a plurality of receptacles embedded at the corner areas.

Selected embodiments will now be explained with reference to the drawings. It will be apparent to those skilled in the construction field from this disclosure that the following descriptions of the embodiments are provided for illustration only and not for the purpose of limiting the invention as defined by the appended claims and their equivalents.

Referring initially to FIGS. 1-7, a multi-story building 10 is illustrated that is constructed using a multi-story building floor support system 12 in accordance with a first embodiment. The building 10 has a base 14, a roof 16, a plurality of elevations 18 at which a plurality of floors 20 are constructed, and at least one building core 22, which supports the lateral and gravity loads of the building 10.

Constructing the multi-story building 10 using a building core 22 (or a plurality of building cores) eliminates the use of columns and bracing elements. Preferably, the building core 22 is constructed from a slip-form process such as vertically slip forming a hardenable substance, such as concrete. Extendable elements, such as hydraulic jacks (not shown), may be used to push the slip form upward off the ground. Hydraulic jacks may also be used at various elevations of the building core 22 to push the slip form further upwards during building core 22 formation. Only one building core 22 is illustrated in this disclosure for the purposes of simplicity. However, it will be apparent to those skilled in the art from this disclosure that the building 10 may include a plurality of building cores formed by slip forming. These building cores can be coupled with one another so that the floor elevations of the building cores are aligned.

Figure 3:
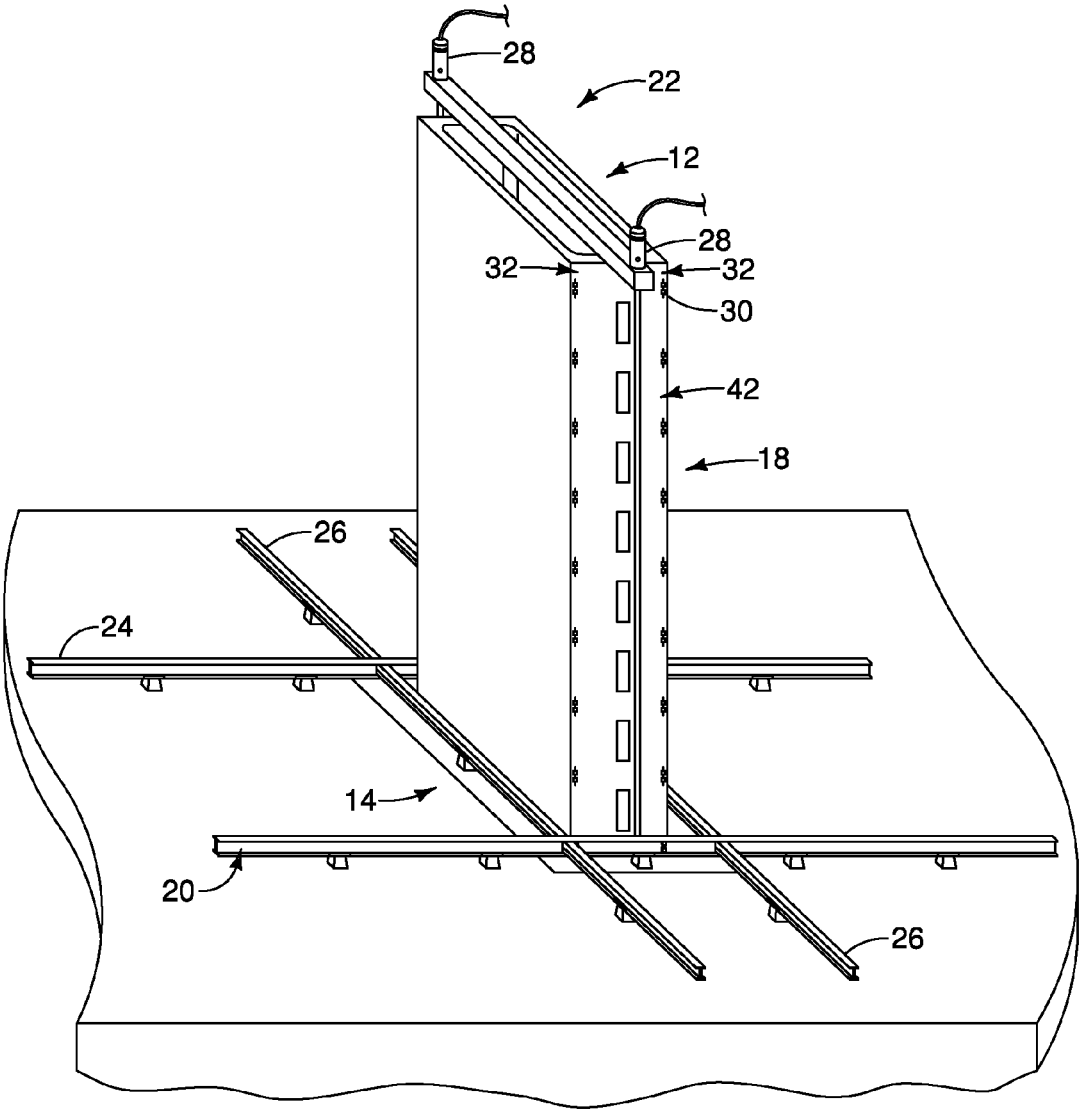
FIG. 3 is a top perspective view of the building core of FIG. 2 showing an incomplete floor structural member at the base of the building core.
Figure 4:
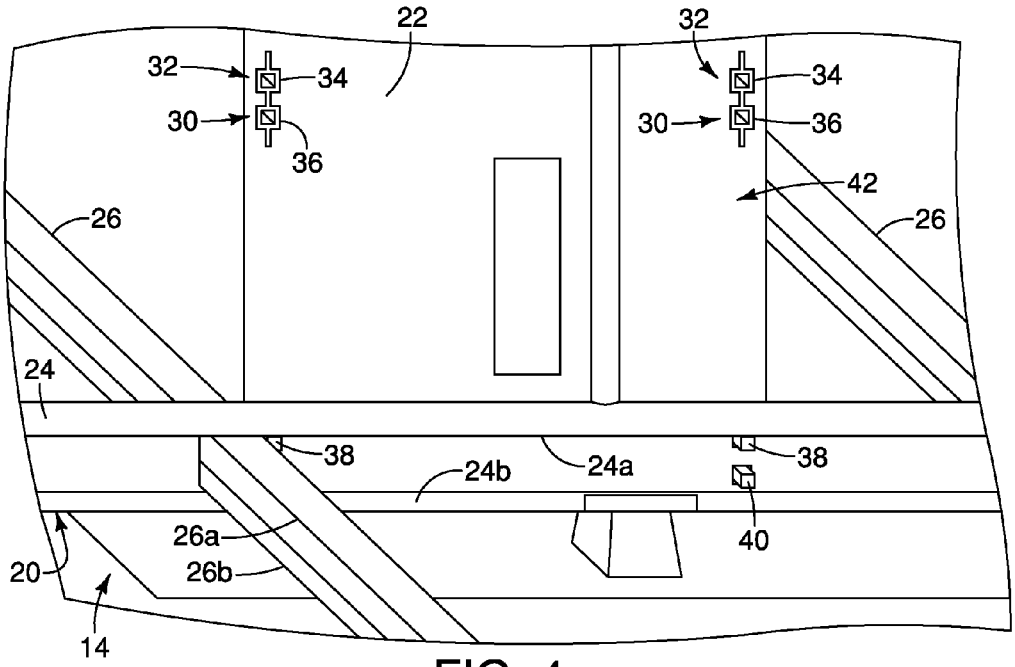
FIG. 4 is enlarged top perspective view of the building core of FIG. 3 showing the support beams inserted into the floor structural member at the base of the building core.
Figure 5:
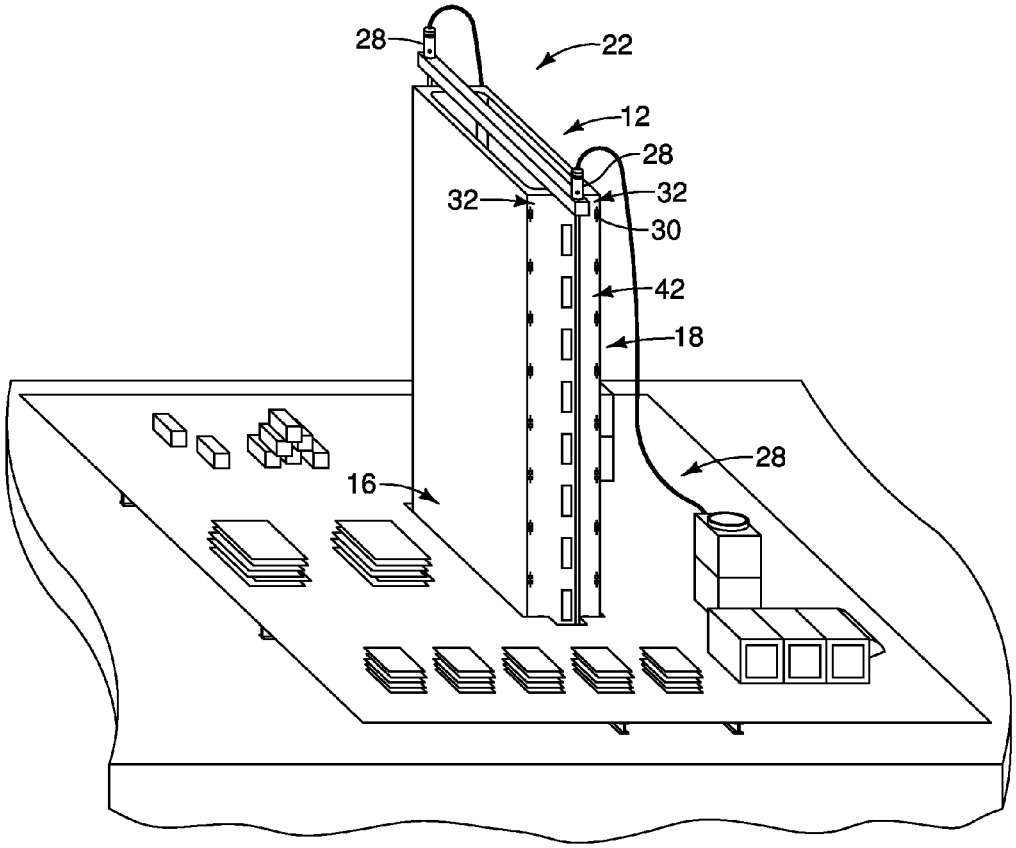
FIG. 5 is a top perspective view of the building core of FIGS. 2 to 4 showing a completed floor structural member at the base of the building core.

As seen in FIGS. 3 and 4, the various floors 20 of the building are constructed at the base 14 of the building 10. In addition, the roof 16 can also be constructed at the base 14 of the building 10. For example, as best seen in FIG. 3, the floor 20 is constructed by coupling at least two floor structural members 24 and 26 together at the base 14 of the building. In this disclosure, any reference to the floor 20 and its components, structure and construction will also include the roof 16 and its components, structure and construction. At this point of construction of the building 10, each floor 20 of the building 10 is constructed at the base 14 of the building 10. In other words, each floor 20 of the building 10 is constructed at ground level, as seen in FIG. 4. The floor 20 is lifted to a desired elevation 18 of the building 10 by devices such as strand jacks 28, as seen in FIG. 5. It will be apparent to those skilled in the art from this disclosure that the successive floors 20 do not need to be completely constructed in a finished state before they are lifted to various levels of the building core 22. Construction and assembly of the floors 20 may also occur during and after lifting. Each floor 20 is constructed by coupling at least two floor structural members 24 and 26 together at the base 14 of the building 10. After lifting a floor 20 to a desired building elevation 18, another floor 20 is constructed at the base 14 of the building 10 by coupling at least another two floor structural members (not shown) together. This process is repeated for the construction of each floor 20.

Turning to FIGS. 6, 7 and 9 to 11, the floor 20 is constructed at the base 14 of the building by coupling at least the first and second floor structural members 24 and 16 together. Preferably, the first floor structural member 24 is a W-type I-beam that has a depth (as measured from a first flange 24*a* to a second flange 24*b* of the first floor structural member 24) of 21 inches and weighs 44 pounds per foot. Preferably, the second floor structural member 26 is also a W type I-beam that has a depth (as measured from a first flange 26*a* to a second flange 26*b* of the second floor structural member 26) of 16 inches and weighs 50 pounds per foot. Thus, the first floor structural member 24 is larger in size than the second floor structural member 26. The first floor structural member 24 includes at least one receiving hole 74 in a mid-sectional area 76 that is sized and dimensioned to receive the second floor structural member 26 therethrough. The receiving hole 74 is preferably a plasma cut hole, which is cut by a thermal process in which a beam of ionized gas heats an electrically conductive metal beyond its melting point and flushes the molten metal through the kerf of the cut. The second floor structural member 26 is inserted through the receiving hole 74 and is thus coupled to the first floor structural member 24. The floor 20 is constructed on the coupled first and second floor structural members 24 and 26 at the base 14 of the building 10. The construction of the floor 20 is not important to the multi-story floor support system 12 and will not be further discussed herein.

Figure 6:
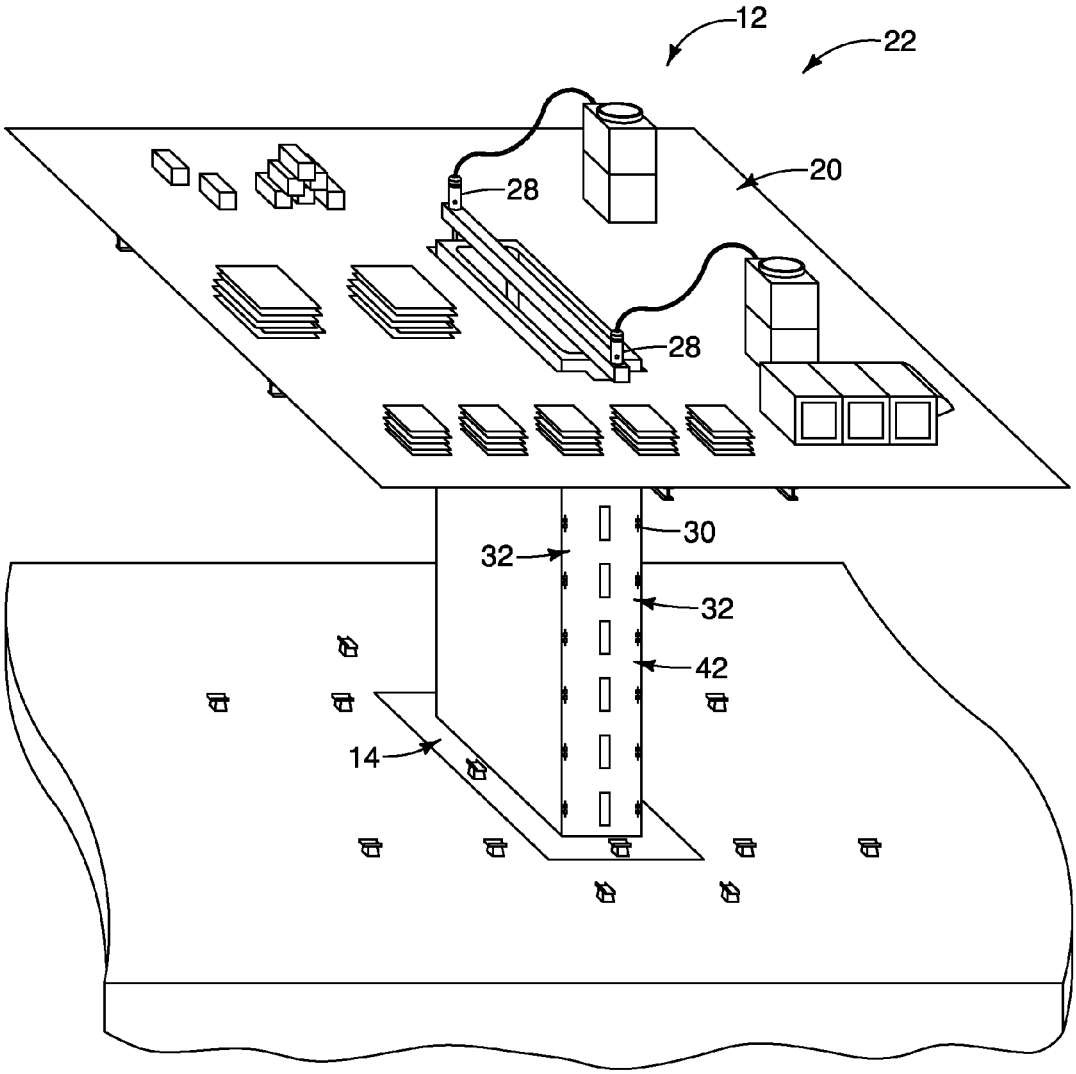
FIG. 6 is a top perspective view of the building core of FIGS. 2 to 5 showing the completed floor structural member lifted to a desired elevation of the building core.

As seen in FIG. 6, the first floor structural member 24 further includes a first through hole 77*a* and a second through hole 77*b*. The first and second through holes 77*a* and 77*b* are configured to receive the first and second support members 38 and 40 of the building floor support system 12 as discussed herein, respectively, which support the coupled first and second floor structural members 24 and 26 (and the floor 20) in the receptacle 30. The first and second through holes 77*a* and 77*b* are also preferably plasma cut holes sized and dimensioned to receive the first and second support members 38 and 40, respectively.

Figure 8:
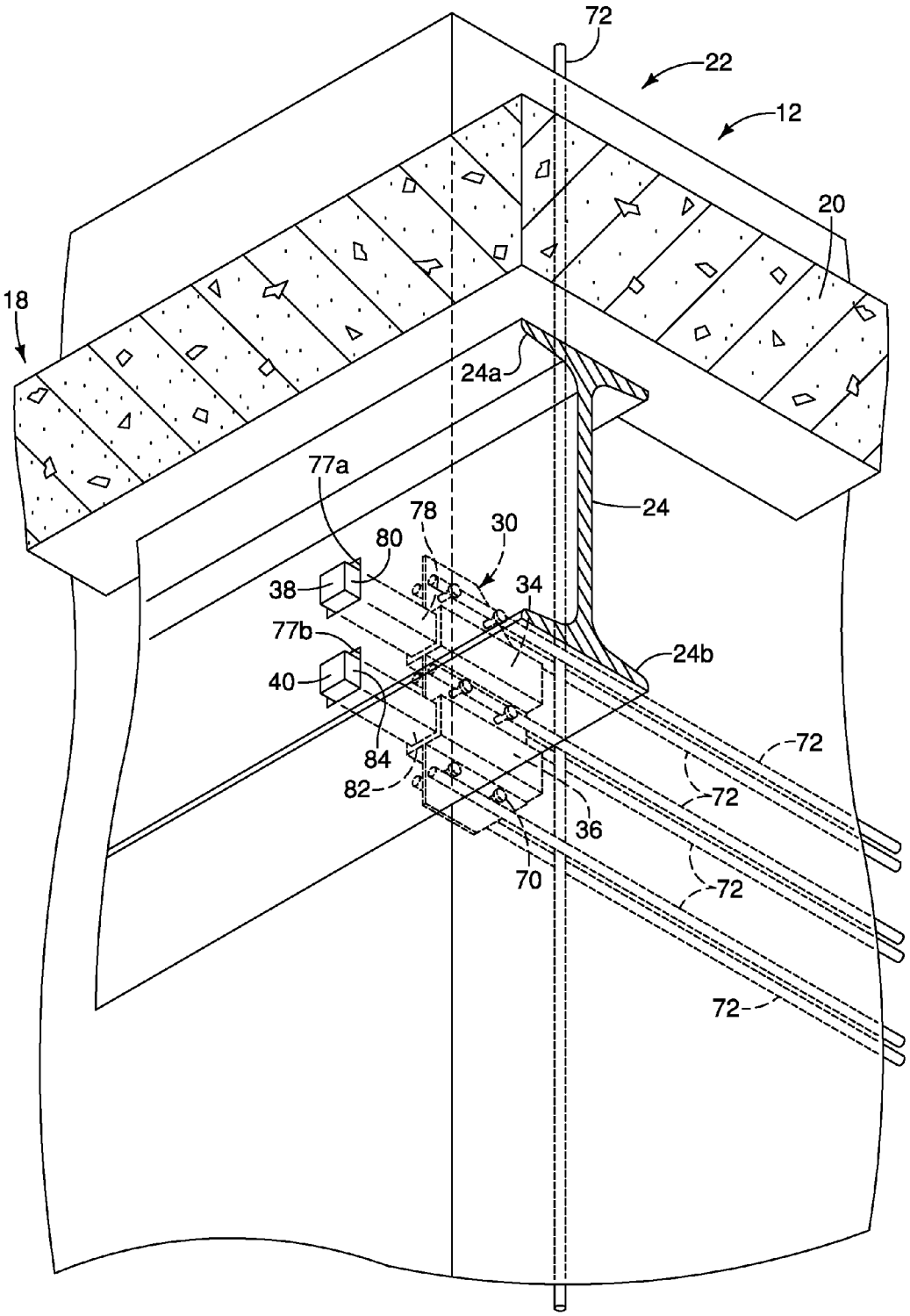
FIG. 8 is a bottom perspective of a receptacle embedded in the building core of FIGS. 2 to 7 showing a floor structural member mounted on the support members.

As shown in FIG. 8, the multi-story building floor support system 12 is directed to the support of the floors 20 at various elevations 18 of the building core 22 after the floors 20 are lifted. In particular, as shown in FIGS. 2 to 5, the multi-story building floor support system 12 comprises a plurality of receptacles 30 embedded at a plurality of corner areas 32 of a perimeter of the building core 22. The multi-story building floor system 12 further comprises a plurality of support members. For the sake of simplicity, only the support members 38 and 40 will be discussed in this disclosure. Each of the support members 38 and 40 is configured to be coupled with the floor structural members 24 and 26, preferably at the base 14 of the building core 22. After the floor structural members 24 and 26 coupled to the support members 24 and 26 are lifted to the desired elevation 18, the support members 24 and 26 are inserted into the receptacle 30 to support the floor structural members at the desired elevation 18.

As previously stated, the receptacles 30 are embedded at least partially into the building core 22 during slip forming and before the concrete hardens. The building core 22 has a plurality of corner areas 32 at each elevation. Each receptacle 30 is embedded into a corner area 32 of the building core 22. Thus, in the illustrated embodiment, the multi-story building floor system 12 is designed such that each elevation of the building core 22 has four receptacles 30 embedded into the corner areas 32. The receptacles 30 are identical in size and structure so further description of the receptacles 30 will be in reference to a single receptacle 30.

In the current embodiment, the receptacle 30 is sized and dimensioned to be lightweight to reduce the cost of materials and construction. Specifically, in the illustrated embodiment, the receptacle 30 is designed to be 33 inches in height, 5 inches in width, and extends 12 inches into the building core 22. That is, when the receptacle 30 is embedded into the building core 22, it spans 33 inches long, 5 inches wide and extends 12 inches into the building core 22. However, it will be apparent to those skilled in the art that the size and dimensions of the receptacle 30 can be adjusted as desired.

The receptacle 30 includes at least one chamber 34. As best seen in FIGS. 8 to 11, in the illustrated embodiment, the receptacle 30 includes two chambers, a first chamber 34 and a second chamber 36. The receptacle 30 further includes a first support plate 64, a second support plate 66 and a third support plate 68 that are shop welded to selected portions of the first and second chambers 34 and 36. The first, second and third support plates 64, 66 and 68 are structured and dimensioned to secure the receptacle 30 in the building core 22. In this manner, each of the first, second and third support plates 64, 66 and 68 includes at least one retaining member 70 that is configured to be fixedly attached to building structural members 72. Preferably, the receptacle includes a plurality of retaining members 70 that protrude laterally from the first, second and third support plates 64, 66 and 68. The retaining members 70 are configured to be fixedly attached to a plurality of building structural members 72 to secure the receptacle 30 into the building core 22. Thus, the receptacle 30 is supported by the retaining members 70 in the building core 22.

Figure 9:
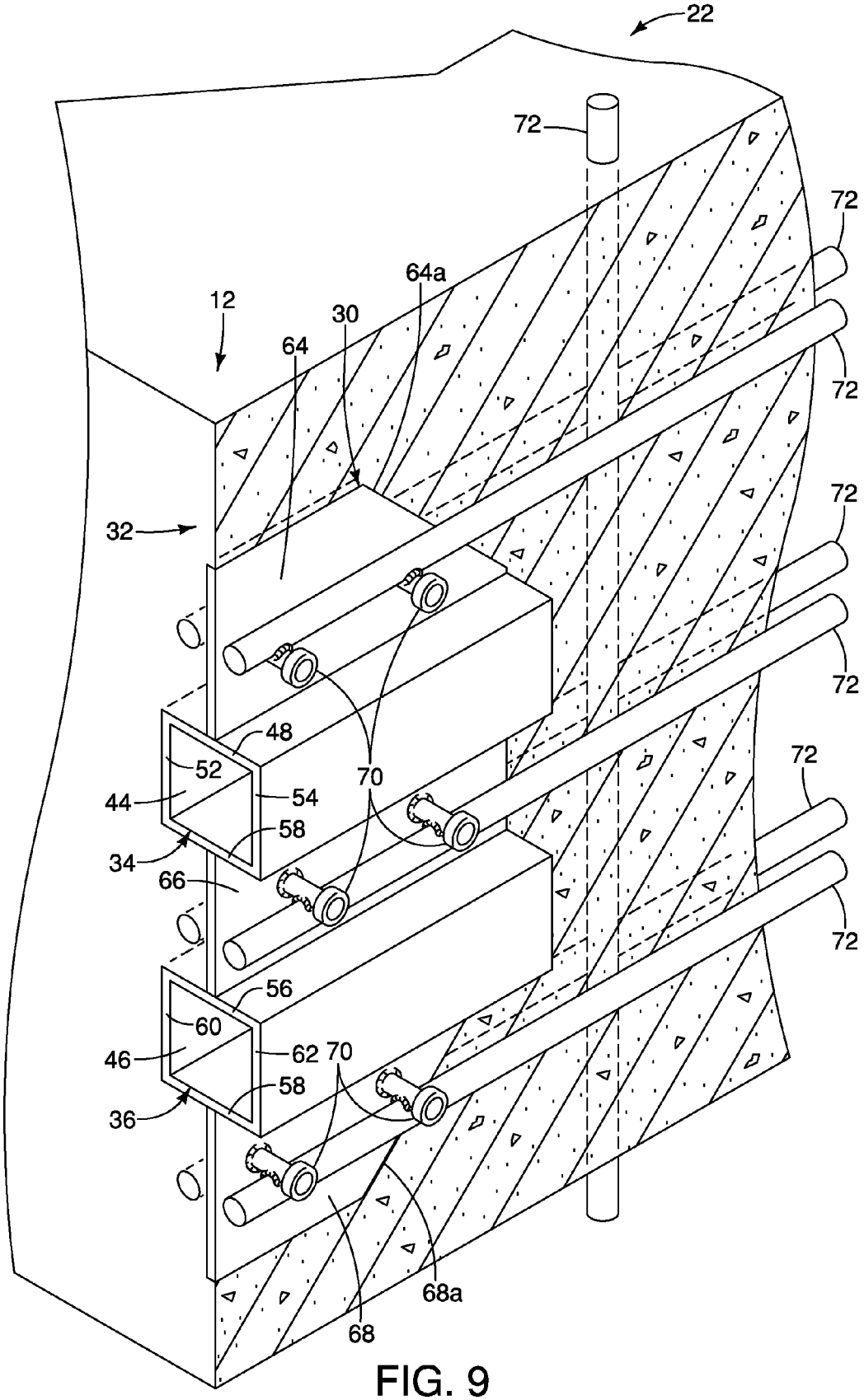
FIG. 9 is a cross-sectional perspective view of a portion of the building core of FIGS. 2 to 7 showing a receptacle embedded into the building core.
Figure 10:
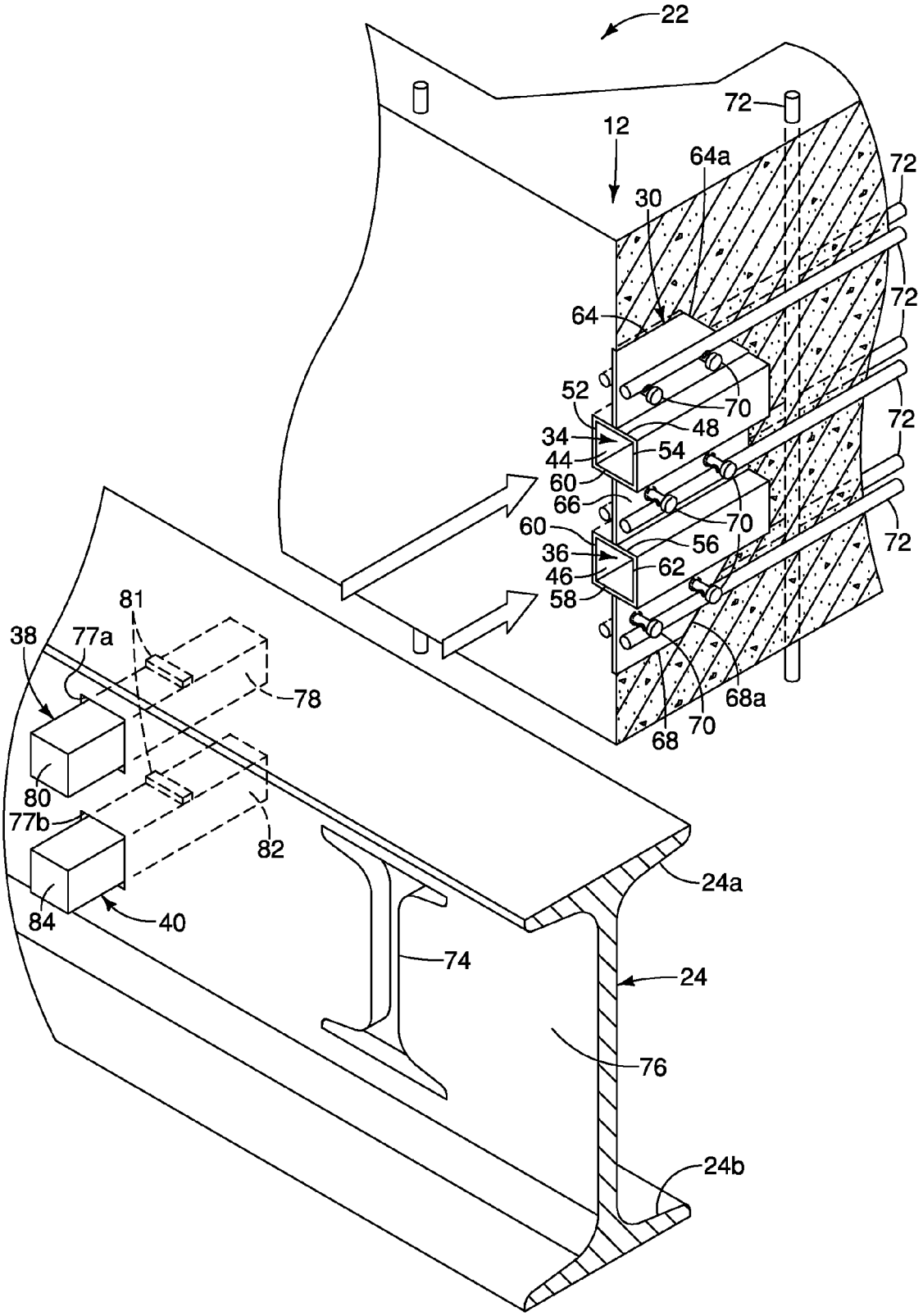
FIG. 10 is a top perspective of the receptacle of FIGS. 8 and 9 and a floor structural member in section having support members to be supported at the receptacle offset.

As shown in FIG. 9, the first chamber 34 includes a first insertion opening 44 that is structured to receive the first support member 38. The second chamber 36 includes a second insertion opening 46 that is structured to receive the second support member 40 for the floor 20 to support the floor 20 thereon. Thus, the first chamber 34 and the second chamber 36 of the receptacle 30 are vertically aligned. In the illustrated embodiment, the first chamber 34 is a top chamber when the receptacle 30 is embedded into the building core 22 and the second chamber 36 is a bottom chamber. As previously mentioned, the first and second floor structural members 24 and 26 are configured to be coupled to the first and second support members 38 and 40 at the base 14 of the building 10. In this manner, the receptacle 30 is structured and positioned in the corner area 32 of the building core 22 to support the floor 20 in the first and second chambers 34 and 36 of the receptacle 30.

As shown in FIGS. 2 to 7, the receptacle 30 is embedded at a perimeter 42 of the building core 22 and includes the first chamber 34 and the second chamber 36. The receptacle 30 is embedded into the building core 22 during slip forming such that first and second insertion openings 44 and 46 of the chambers remain open. The first and second insertion openings 44 and 46 can be temporarily filled with a removable substance (not shown) so that the inside of the first and second chambers 34 and 36 are unobstructed by debris or concrete during slip forming. As the first and second chambers 34 and 36 are identical in size and structure, only the first chamber 34 will be further discussed herein.

Figure 7:
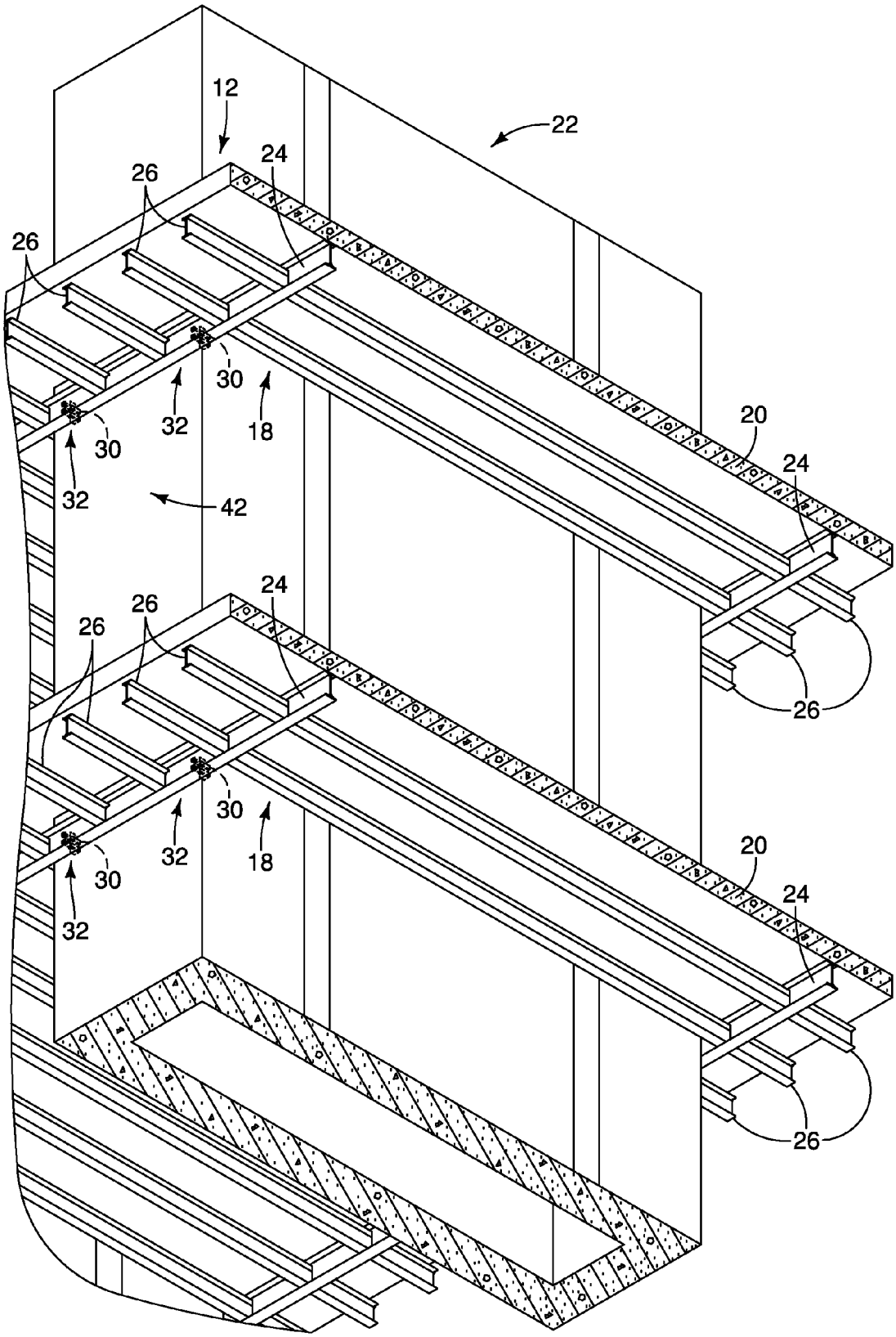
FIG. 7 is a bottom perspective view of the building core of FIGS. 2 to 6 showing a plurality of floor structural members supported at the receptacles.

Referring now to FIGS. 6 and 7, as previously stated, the first chamber 34 is configured to receive and support the first support member 38 of the floor 20. Preferably, the first chamber 34 has a substantially square shape that is 4 inches long, 5 inches wide and 12 inches deep. Thus, when the receptacle 30 is embedded in the building core 22, the first chamber 34 extends 4 inches lengthwise, 5 inches in width and extends 12 inches into the building core 22.

In the illustrated embodiment, the first chamber 34 is constructed of four steel plates. Specifically, the first chamber 34 has a first horizontal plate 48 and a second horizontal plate 50. In the illustrated embodiment, the first and second horizontal plates 48 and 50 define the top and bottom outer surfaces of the first chamber 34, respectively. The first chamber 34 also has a first vertical plate 52 and a second vertical plate 54. In the illustrated embodiment, the first and second vertical plates 52 and 54 define the outer side surfaces of the first chamber 34. The first and second horizontal plates 48 and 50 are steel plates that are preferably 5 inches wide, ½ inch thick and extend 12 inches into the building core 22 12 when the receptacle 30 is embedded. The first and second vertical plates 52 and 54 are steel plates that are preferably 4 inches long, ½ inch thick and extend 12 inches into the building core 22 when embedded. In this manner, the first chamber 34 spans 5 inches in the horizontal plane, 4 inches in the vertical plane and extends 12 inches into the building core 22. As previously stated, the first chamber 34 has the first receiving opening that is configured to receive the first support beam. Preferably, the inner walls of the first chamber 34 are lined with a lubricating member or substance (not shown) such as Teflon coating to facilitate insertion of the first support member 38 into the first chamber 34.

As previously stated, the receptacle 30 further includes the second chamber 36 with the second insertion opening 46 that is configured to receive and support the second support member 40 therein. The second chamber 36 is identical in size and structure to the first chamber 34. The second support plate 66 has first and second horizontal plates 48 and 50 as well as first and second vertical plates 52 and 54 in the same structure and configuration as the first chamber 34.

As previously stated, the receptacle 30 further includes the first, second and third support plates 64, 66 and 68. The first, second and third support plates 64, 66 and 68 serve to connect and retain the first and second chambers 34 and 36 inside the building core 22. In particular, the first, second, and third support plates 64, 66 and 68 are shop welded to portions of the first and second chambers 34 and 36 to form the receptacle 30. Preferably, in the illustrated embodiment, each of the first, second and third support plates 64, 66 and 68 are structured as ⅜ inch thick plates and are preferably sized so that they extend 12 inches into the building core 22 after embedding.

The first support plate 64 is a top plate that is shop welded to the first horizontal plate 48 (the top plate) of the first chamber 34. The first support plate 64 protrudes from the top outer surface of the first chamber 34. Thus, the first support plate 64 is a top plate of the receptacle 30 when the receptacle 30 is embedded into the building core 22. In the illustrated embodiment, the first support plate 64 measures preferably 6 inches in length when the receptacle 30 is embedded into the building core 22. As seen in FIGS. 6 to 9 of the present disclosure, the first support plate 64 preferably has a slanted inner side edge **64*a* to reduce the weight of the first support plate 64 and thus the cost of materials. The third support plate 68 is a bottom plate that is identical to the first support plate 64 and is preferably 6 inches long. The third support plate 68 is shop welded to the second horizontal plate 50 (the bottom plate) of the second chamber 36. The third support plate 68 protrudes from the bottom surface of the second chamber 36. Thus, the third support plate 68 is a bottom plate of the receptacle 30. The third support plate 68 also has a slanted side edge 68*a*** to reduce weight and the cost of materials.

The first and second support plate **66*s* are connected by the second support plate 66, which is shop welded to the second horizontal plate 50 (the bottom plate) of the first chamber 34 and the first horizontal plate 48 (the top plate) of the second chamber 36. The second support plate 66 protrudes from the bottom outer surface of the first chamber 34 and the top outer surface of the second chamber 36. In this manner, a top surface of the second chamber 36 is connected to the second support plate 66 of the first chamber 34 so that the second chamber 36 is vertically aligned with the first chamber 34**.

As previously mentioned, each of the first, second and third support plates 64, 66 and 68 includes at least one retaining member 70 protruding laterally therefrom. In the illustrated embodiment, each of the first, second and third support plates 64, 66 and 68 include 2 pairs of retaining members 70. Each one of the retaining member 70 of the pair of retaining members 70 protrudes in laterally opposite directions from its respective support plate. The retaining members 70 are identical in size and construction and thus further description of the retaining members 70 will be in reference to a single retaining member 70 of the first support plate 64. Preferably, the retaining member 70 is a Nelson stud. The retaining member 70 is secured to the first support plate 64 by stud welding in which the retaining member 70 is welded to the first support plate 64. The retaining member 70 is preferably ⅞ inches long. Thus, the retaining member 70 protrudes approximately ⅞ inches laterally from the first, second, or third support plate 68 when the receptacle 30 is embedded into the building core 22. The retaining member 70 is configured to fixedly contact a building structural member 72 of the building core 22 to secure the receptacle 30 into the building core 22. In the illustrated embodiment, the building structural remember 72 is a rebar and preferably a #5 rebar. As seen in FIGS. 8 to 11, the building core 22 is supported by a matrix of building structural members 72 that are shop welded to the retaining member 70*s* of the receptacles 30. In this manner, the receptacle 30 is secured to the building structural members 72 of the building core 22 and is thus securely embedded inside the building core 22. The illustrated embodiment shows the building structural members 72 that secure the receptacle 30 inside the building core 22 to be rebars. It will be apparent to one skilled in the art from this disclosure that other types of retaining members 70 can be used with the multi-story floor support system 12, such as steel mesh manufactured under the trademark Bau-Grid.

The first and second support members 38 and 40 will now be discussed in greater detail. As the first and second support members 38 and 40 are identical in size and construction. Thus, further description of the first and second support members 38 and 40 will be made in reference to the first support member 38 only. The first support member 38 is preferably a solid steel bracket that is approximately 10 inches long. The first support member 38 has a first end section 78 and a second end section 80. The first end section 78 is configured to be inserted into the first insertion opening 44 of the first chamber 34 such that the second end section 80 projects outwardly from the first insertion opening 44 of the first chamber 34. Preferably, the first support member 38 is inserted through the first through hole 77*a* of the first floor structural member 24 at the base 14 of the building 10. Thus, when the floor 20 is constructed on the coupled first and second floor structural members 24 and 26, the first support member 38 the first through hole 77*a* has the first support member 38 inserted therethough. The first support member 38 may be pushed into the first insertion opening 44 of the first chamber 34 by a hydraulic ram or a screw jack (not shown) that can be mounted on the second floor structural member 26. After insertion of the first support member 38 into the first chamber 34, the first chamber 34 can be filled with an epoxy or mortar to secure the first support member 38 therein. The coupled first and second floor structural members 24 and 26 are mounted on the first support member 38 such the second end section 80 of the first support member 38 will protrude from the first through hole 77*a* of the first structural member 24. Thus, the floor 20 is supported by the first support member 38 in the receptacle 30.

In the illustrated embodiment, the first support member 38 is configured to be inserted approximately 5 inches into the first insertion opening 44 of the first chamber 34 such that the first support member 38 protrudes 5 inches out of the first insertion opening 44. Optionally, stoppers 81 can be used to indicate the desired insertion amount of the first support member 38 into the first chamber 34.

As previously stated, the multi-story building support system 12 further comprises the second support member 40 that is configured to be inserted into the second insertion opening 46 of the second chamber 36 of the receptacle 30. In the same manner as the first support member 38, when the second support member 40 is supported in the second chamber 36, a first end section 82 of the second support member 40 is inserted into the second chamber 36 while a second end section 84 of the second support member 40 projects outwardly from the second insertion opening 46. The second end section 84 of the second support member 40 also extends through the second through hole 77*b* of the first floor structural member 24 that is coupled to the second floor structural member 26. In this manner, the floor 20 is supported by the first and second support members 38 and 40 within the receptacle 30. As each floor 20 of the building 10 is constructed at the base 14 and then lifted to its desired elevation 18, the first and second floor structural members 24 and 26 of each floor 20 are supported at its elevation 18 by the first and second support members 38 and 40.

Figure 11:
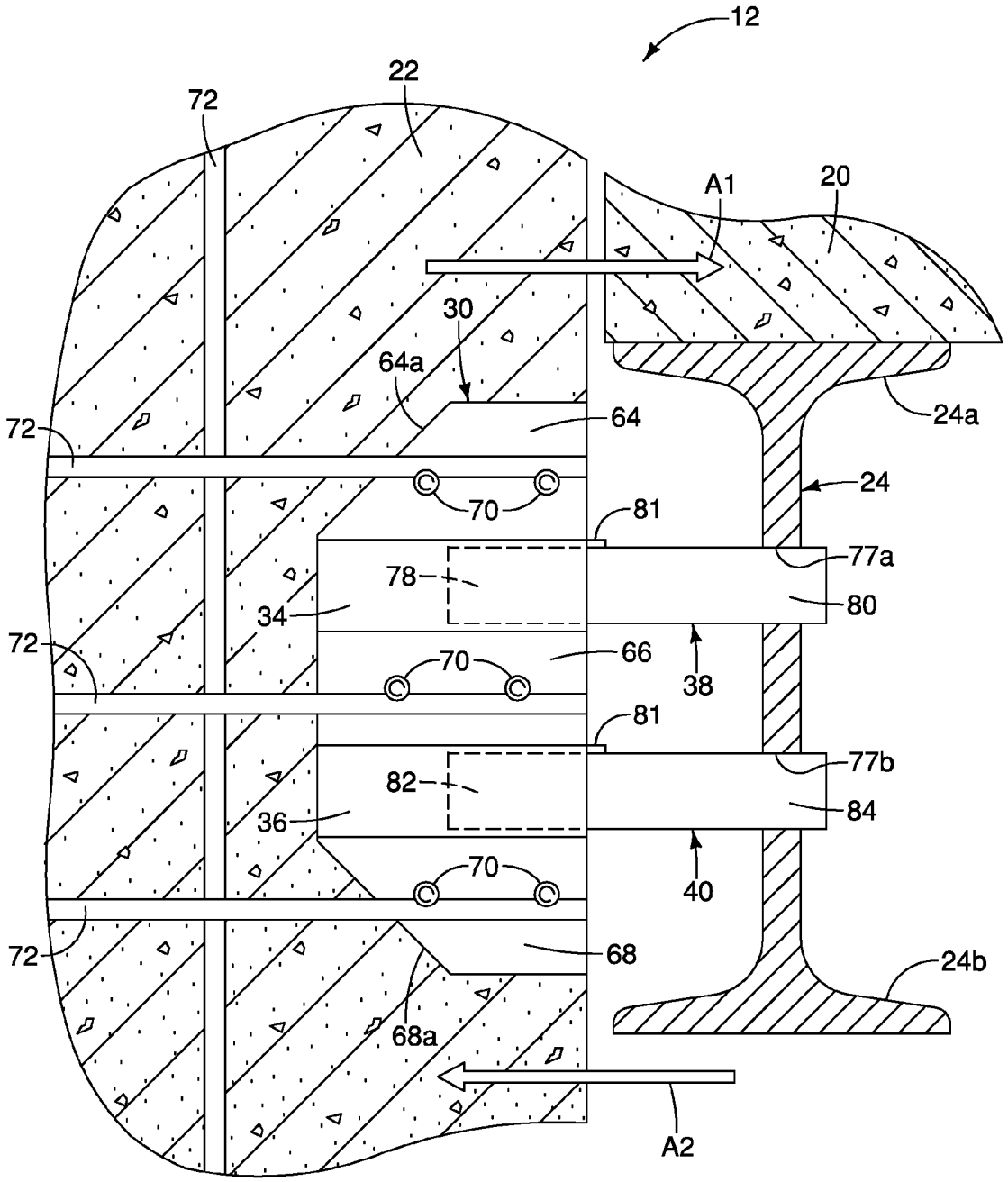
FIG. 11 is a cross-sectional side view of the receptacle of FIGS. 9 to 10 having a portion of a floor structural member mounted to support members that are supported in the receptacle.

As shown in FIG. 11, when the floor 20 is supported in the receptacle 30, the receptacle 30 experiences a great amount of shear force in the direction indicated by the arrow A1 and an equal amount of compression force in the direction indicated by the arrow A2. To prevent the receptacle 30 from becoming unstable or being torn out from the building core 22, the retaining members 70 of the receptacle 30 are shop welded to the building structural members 72, as previously mentioned. Given the structure of the receptacle 30 as having a plurality of thin support plates, the required amount of steel reinforcement (i.e., the building structural members 72) can be reduced. Also, given the configuration that the first and second support members 38 and 40 need only extend into the first and second chambers 34 and 36 by 5 inches, and that the receptacle 30 extends into the building core 22 only 12 inches, required amount of steel for the floor support system 12 of the current embodiment is substantially reduced in comparison to similar systems known in the art. In the illustrated embodiment, the multi-story building floor support system 12 is configured and structured such that the steel reinforcement provided for the receptacle 30 is the minimum amount required to satisfy the American Concrete Institute's Building Code Requirements for Structural Concrete.

Figure 12:
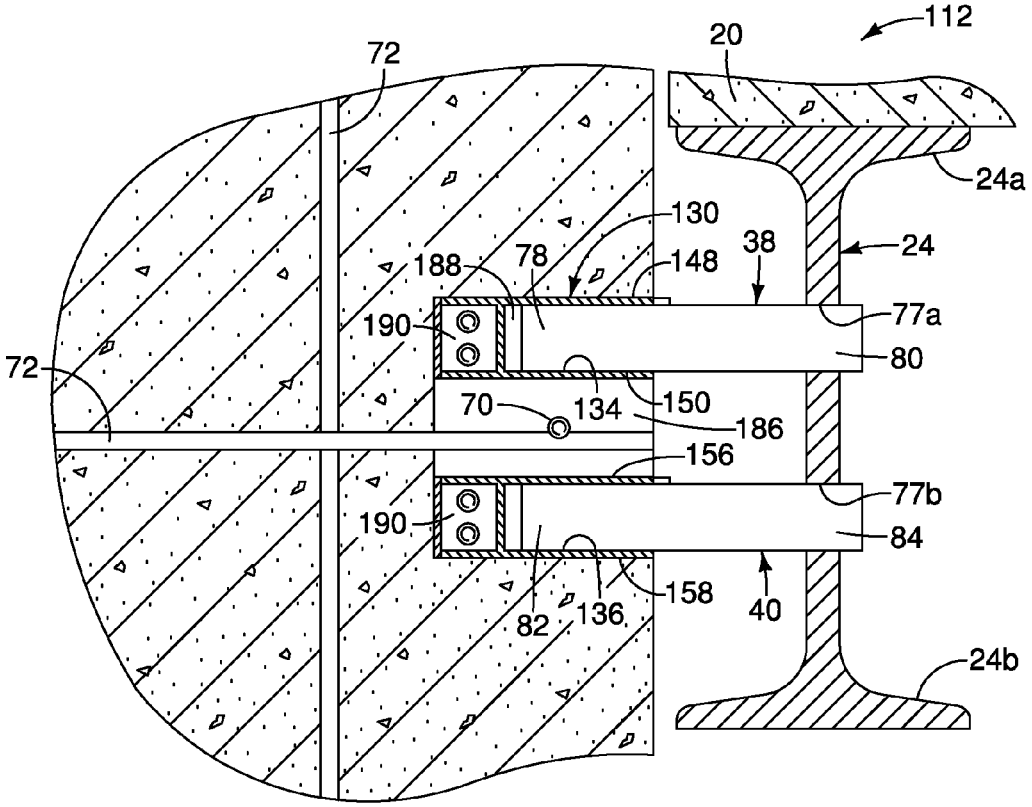
FIG. 12 is a cross-sectional side view of a multi-story floor support system in accordance with a second embodiment.

Referring now to FIG. 12, a multi-story building floor support system 112 in accordance with a second embodiment will now be discussed. Due to the similarity between the multi-story building floor support system 112 and the multi-building floor support system 12 of the first embodiment, the multi-story building floor support system 112 will only be briefly discussed. Also, those elements that are identical to that in the first illustrated embodiment will receive the same reference numerals herein.

The multi-story building floor system 112 includes at least one receptacle 130 (preferably a plurality of receptacles 130) that is configured to be embedded into a building core 22 of a building 10 during slip forming. The receptacle 130 also includes a first chamber 134 and a second chamber 136 that are vertically aligned. The first and second chambers 134 and 136 have the same dimensions as the first and second chambers 34 and 36 of the first illustrated embodiment. That is, the first and second chambers 134 and 136 are preferably both 4 inches long and 5 inches wide when the receptacle 130 is embedded into the building core 22. Preferably, the first and second chambers 134 and 136 extend into the building core 22 approximately 12 inches. The first and second chambers 134 and 136 are identical in structure and size so only the first chamber 134 will be discussed for the sake of brevity.

The first chamber 134 is constructed of first and second horizontal plates 148 and 150 that are identical to the first and second horizontal plates 48 and 50 of the first chamber 34 of the first illustrated embodiment. The first chamber 134 is further constructed of first and second vertical plates (not shown) that are identical to the first and second vertical plates 52 and 54 of the first illustrated embodiment. The first and second chambers 134 and 136 are connected by a single support plate 186 that is made of steel. The support plate 186 is preferably 5 inches in length and extends into the wall 12 inches. The support plate 186 is welded to the second horizontal plate 150 (the bottom plate) of the first chamber 134 and is welded to the first horizontal plate 156 (the top plate) of the second chamber 136. The support plate 186 includes at least one retaining member 70 protruding laterally therefrom. Preferably, the support plate 186 includes at least a pair of retaining members 70, each one of the pair protruding in laterally opposite directions on the support plate 186. Preferably, the retaining member 70 is a Nelson stud and is configured to be stud welded to the support plate 186. The retaining members 70 are identical to the retaining members 70 of the first illustrated embodiment and are configured to contact and be welded to building structural members 72 of the building core 22, such as rebar or steel mesh.

The first chamber 134 includes an outer portion 188 and an inner portion 190. Similarly, the second chamber 136 includes an outer portion 192 and 194. For the sake of brevity, only the first chamber 134 will be further discussed herein. The inner portion 190 of the first chamber 134 includes at a pair of retaining members 70 that is configured to secure the receptacle 130 inside the building core 22. In the illustrated embodiment, the inner portion 190 includes two pairs of retaining members 70, each one securing the receptacle 130 to the building core 22 at a side wall (not shown) of the inner portion 190.

The outer portion 188 of the first chamber 134 is configured to receive a first support member 38 therein. The first support member 38 can be identical to the first support member 38 of the first illustrated embodiment. Alternatively, the first support member 38 can have a different size and dimensions, as desired. Preferably, the first support member 38 is a solid steel bracket that preferably measures 4.5 inches in width, 4 inches in height and is 12 inches long. The first support member 38 is inserted into the outer portion 188 of the first chamber 134 by approximately 6 inches. Thus, the first support member 38 is configured to protrude out of the first chamber 134 by 6 inches. The first support member 38 is coupled to a first building structural member 24 to support such that when the first support member 38 is inserted into the first chamber 134, a floor 20 is supported in the receptacle 130. The second support member 40 is identical in size, construction and functionality to the first support member 38 and will not be further discussed herein. The floor 20 is of the second illustrated embodiment is supported by the first and second support members 38 and 40 in the same manner as that in the first illustrated embodiment.

Figure 13:
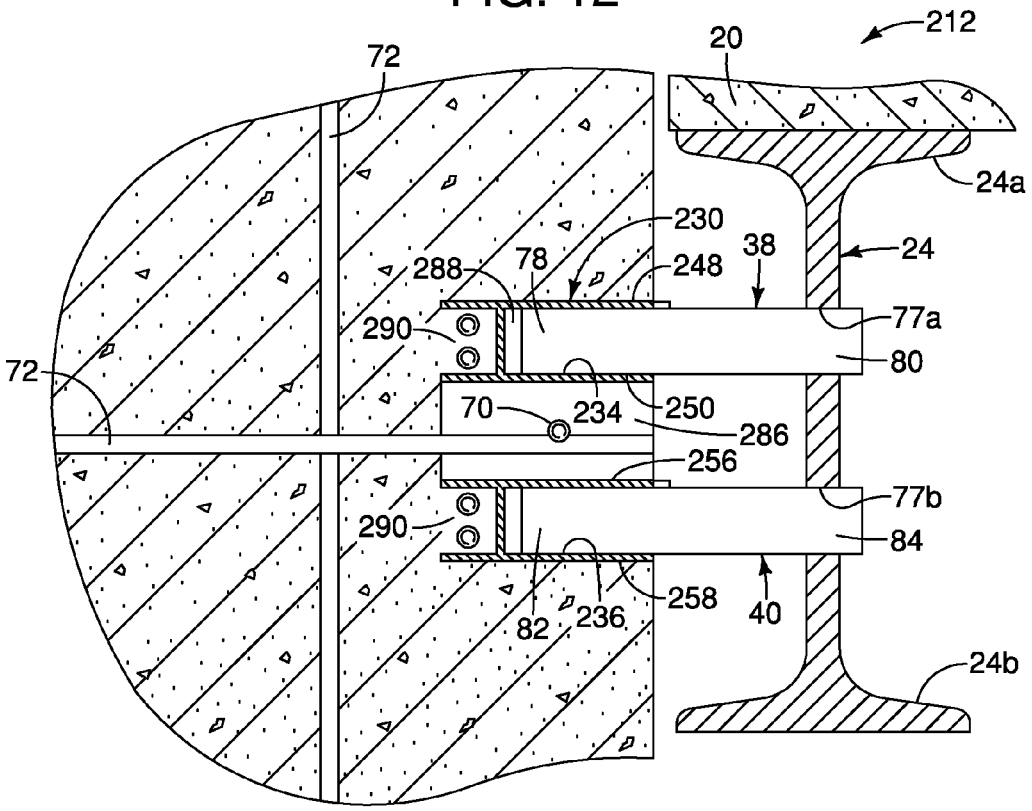
FIG. 13 is a cross-sectional side view of a multi-story floor support system in accordance with a third embodiment.

Referring now to FIG. 13, a multi-story floor support system 212 in accordance with a third embodiment will now be discussed. The multi-story floor support system 212 of the third embodiment is identical to the multi-story floor support system 112 of the second embodiment except that the receptacles 130 are replaced with the receptacles 230. The receptacles 230 are identical in size, dimension, configuration and functionality as that of the second illustrated embodiment except that the inner portions 290 of the first and second chambers 134 and 136 are open ended. That is, configuration allows for a reduction in the amount of steel and materials necessary to construct the receptacles 230 and thus is cost saving.

Thus, the receptacle 230 includes a first chamber 234 and a second chamber 236 that are vertically aligned and connected by a support plate 286 that is identical to the support plate 186 of the second illustrated embodiment. The first chamber 234 includes an outer portion 288 and an inner portion 290. The second chamber 236 includes an outer portion 292 and an inner portion 294. For the sake of brevity in this disclosure, only the first chamber 234 will be further discussed herein. The inner portion 290 of the first chamber 234 includes at a pair of retaining members 70 that is configured to secure the receptacle 230 inside the building core 22. In the illustrated embodiment, the inner portion 290 includes two pairs of retaining members 70, each one securing the receptacle 230 to the building core 22 at a side wall (not shown) of the inner portion 290.

The outer portion 288 of the first chamber 234 is configured to receive a first support member 38 therein. The first support member 38 is identical to the first support members 38 and 138 of the first and second embodiments. Of course, it will be apparent to those skilled in the art that the first support member 38 can have a different size and dimensions, as desired. The first support member 38 is inserted into the outer portion 288 of the first chamber 234 by approximately 6 inches. Thus, the first support member 38 is configured to protrude out of the first chamber 234 by 6 inches. The first support member 38 is coupled to a first building structural member 24 to support such that when the first support member 38 is inserted into the first chamber 134, a floor 20 is supported in the receptacle 130.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts unless otherwise stated.

Also it will be understood that although the terms "first" and "second" may be used herein to describe various components these components should not be limited by these terms. These terms are only used to distinguish one component from another. Thus, for example, a first component discussed above could be termed a second component and vice-a-versa without departing from the teachings of the present invention. The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives. Finally, terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A multi-story building floor support system comprising:

a receptacle configured to be embedded into a building core, the receptacle including a first chamber with a first insertion opening, a first support plate protruding from a top surface of the first chamber and a second support plate protruding from a bottom surface of the first chamber, the first and second support plates being structured to retain the receptacle inside the building core; and a first support member having a first end section and a second end section, the first end section being configured to be inserted into a first receiving opening of the first chamber such that the second end section projects outwardly from the first receiving opening of the first chamber.

2. The multi-story building support system according to claim 1, wherein each of the first and second support plates include at least one retaining member protruding laterally therefrom, each retaining member being configured to fixedly contact a structural member of the building core to secure the receptacle into the building core.

3. The multi-story building support system according to claim 2, wherein the receptacle includes a second chamber with a second insertion opening, a top surface of the second chamber being connected to the second support plate of the first chamber so that the second chamber is vertically aligned with the first chamber, the receptacle further including a third support plate protruding from a bottom surface of the second chamber.

4. The multi-story support system according to claim 3, wherein the third support plate includes at least one retaining member protruding laterally therefrom, the retaining member being configured to fixedly contact an additional structural member of the building core to secure the receptacle inside the building core.

5. The multi-story support system according to claim 4, wherein each of the first, second and third support plates includes a pair of retaining members, each retaining member of the pair protruding in laterally opposite directions of the support plates.

6. The multi-story building support system according to claim 3, wherein the second end section of the first support member is configured to be inserted into a first through hole of a floor structural member such that the floor structural member is supported by the first support member in the receptacle.

7. The multi-story building support system according to claim 6, further comprising a second support member having a first end section and a second end section, the first end section of the second support member being configured to be inserted into the second insertion opening of the second chamber such that the second end section of the second support member projects outwardly from the second insertion opening.

8. The multi-story building support system according to claim 7, wherein the second end section of the second support member is configured to be inserted into a second through hole of the floor structural member such that the floor structural member is supported by the second support member in the receptacle.

9. A multi-story building floor support system comprising:

at least one building core constructed from slip-forming the building core having a plurality of corner areas at each elevation;

a plurality of receptacles, each of the receptacles being configured to be embedded into the building core and having a first chamber that is a top chamber and a second chamber that is a bottom chamber such that the first and second chambers are vertically aligned, the first chamber being configured to receive a first support member, the second chamber being configured to receive a second support member; and a plurality of floor structural members, each of the floor structural members being supported at an elevation by the support members.

10. The multi-story building support system according to claim 9, wherein the each of the receptacles further includes a top plate protruding from a top surface of the first chamber, a bottom plate protruding from a bottom surface of the second chamber, and a middle plate connecting a bottom surface of the first chamber with a top surface of the second chamber.

11. The multi-story building support system according to claim 10, wherein the top, bottom and middle plates each include at least one retaining member protruding laterally therefrom that are configured to fixedly contact structural members of the building core to secure the receptacles inside the building core.

12. The multi-story building support system according to claim 9, wherein each of the first and second chambers include an inner portion and an outer portion separated by an internal wall, the outer portion is configured to receive one of the first and second support members, the inner portion having at least one retaining member configured to secure the receptacles inside the building core.

13. The multi-story building support system according to claim 12, wherein the inner portion is an open-ended structure.

14. A method of constructing a multi-story building support system, comprising:

depositing at least one receptacle at a perimeter of a building core;

inserting one of a first end section and a second end section of a support beam through a cavity of a structural member having a floor structural member supported thereon to form a joined support structure;

inserting one of the first end section and the second end section of the support beam into a receiving opening of the receptacle so that the joined support structure is mounted to the building core.

* * * * *